US007225818B2

(12) United States Patent
Kim et al.

(10) Patent No.: US 7,225,818 B2
(45) Date of Patent: Jun. 5, 2007

(54) WATER SPRAYING DEVICE AND SYSTEM FOR DISHWASHERS

(75) Inventors: Jae Y. Kim, Los Angeles, CA (US); John B. Harp, Palmdale, CA (US)

(73) Assignee: Distinctive Appliances, Inc., Diamond Bar, CA (US)

( * ) Notice: Subject to any disclaimer, the term of this patent is extended or adjusted under 35 U.S.C. 154(b) by 587 days.

(21) Appl. No.: 10/404,731

(22) Filed: Mar. 31, 2003

(65) Prior Publication Data

US 2003/0183255 A1 Oct. 2, 2003

Related U.S. Application Data

(60) Provisional application No. 60/369,474, filed on Apr. 2, 2002.

(51) Int. Cl.
*B08B 3/02* (2006.01)

(52) U.S. Cl. ..... 134/176; 134/179; 134/198

(58) Field of Classification Search ..... 134/172, 134/198, 176, 179

See application file for complete search history.

(56) References Cited

U.S. PATENT DOCUMENTS

| | | | | | |
|---|---|---|---|---|---|
| 1,757,278 | A | * | 5/1930 | Weidman | 134/111 |
| 1,823,583 | A | * | 9/1931 | Biskamp | 134/177 |
| 1,965,870 | A | * | 7/1934 | Walker | 239/240 |
| 2,003,003 | A | * | 5/1935 | Marbury | 134/188 |
| 2,704,083 | A | * | 3/1955 | Low | 134/183 |
| 2,987,260 | A | * | 6/1961 | Sasnett | 239/231 |
| 3,007,200 | A | * | 11/1961 | Paulsen et al. | 425/224 |
| 3,809,106 | A | * | 5/1974 | Crabtree | 134/176 |
| 4,064,887 | A | * | 12/1977 | Geiger et al. | 134/144 |
| 4,172,463 | A | * | 10/1979 | Woolley et al. | 134/176 |
| 5,211,190 | A | * | 5/1993 | Johnson et al. | 134/180 |
| 5,546,968 | A | * | 8/1996 | Jeon et al. | 134/179 |
| 5,662,744 | A | * | 9/1997 | Tuller et al. | 134/25.2 |

FOREIGN PATENT DOCUMENTS

| | | | |
|---|---|---|---|
| JP | 7-236605 | * | 9/1995 |
| JP | 9-206266 | * | 8/1997 |
| JP | 9-285434 | * | 11/1997 |

OTHER PUBLICATIONS

Euorpean Patent Office 0 524 102 Jan. 1993.*
European Patent Office 0 766 945 Apr. 1997.*
European Patent Office 1 232 720 Nov. 2001.*

* cited by examiner

*Primary Examiner*—Frankie L. Stinson
(74) *Attorney, Agent, or Firm*—Connolly Bove Lodge & Hutz LLP

(57) ABSTRACT

Water spraying systems for a dishwasher including water spraying devices for mounting on the ceiling, dish rack and a rotating spray arm of a dishwasher for effectively spraying water throughout the dishwasher cabinet. The device includes a housing on which a spinner is mounted that has an open trough and angled end for effectively spraying water and causing rotation of the spinner without clogging. The small size of the device allows placement in strategic locations for effective water spraying distribution and yet does not obstruct or reduce the placement of dishes, glasses, cups, utensils, pots, pans, etc. in the dish racks.

26 Claims, 10 Drawing Sheets

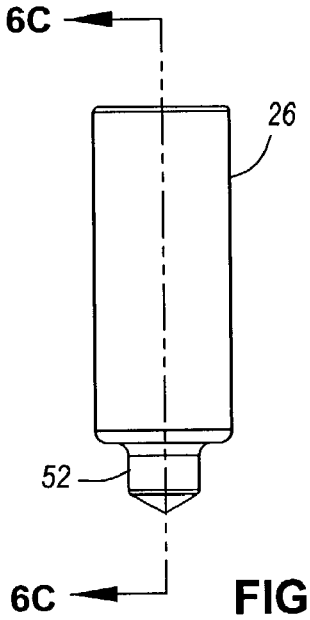
FIG.6A
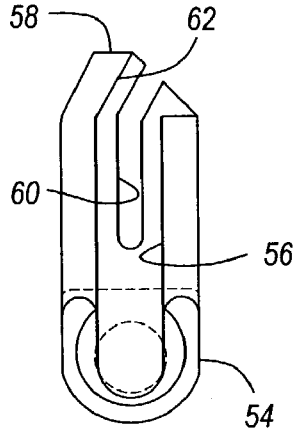
FIG.6B
FIG.6C
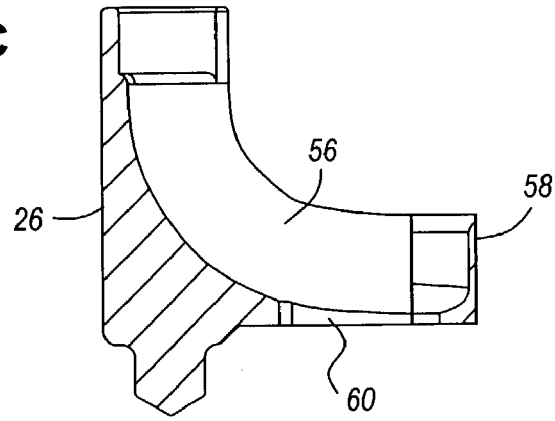
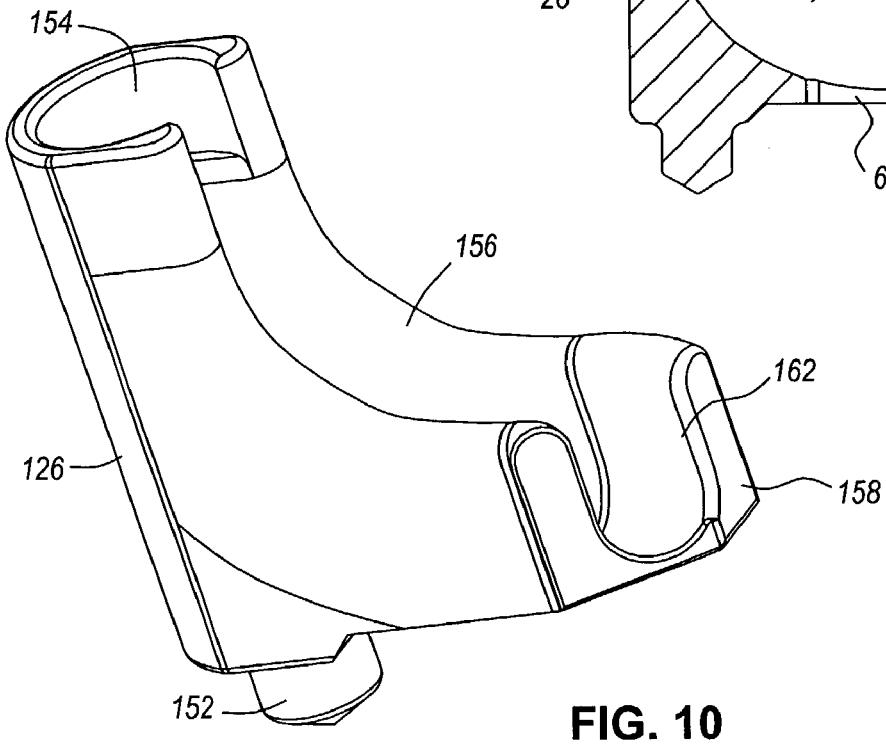
FIG. 10

WATER SPRAYING DEVICE AND SYSTEM FOR DISHWASHERS

This application is based on the Provisional Patent Application Ser. No. 60/369,474, filed Apr. 2, 2002.

The present invention relates to devices for spraying the wash water and rinse water in a dishwasher and, in particular, to water spraying devices that are relatively small for being positioned in various locations in the dishwasher to enhance the water coverage without reducing the usable volume of the dishwasher.

A conventional domestic dishwasher includes a pump for pumping wash water and then rinse water to a rotating spray spinner located in the center near the bottom of the dishwasher cabinet. The spray spinner normally has two or three arms extending outwardly to cover the full width and depth of the dishwasher cabinet and the water spray openings in the arms are aimed in various directions to both cause the spinner to rotate and to spray water throughout the interior of the cabinet. Some dishwashers have a second spray spinner on the ceiling of the dishwasher cabinet or immediately below the upper dish rack to enhance the spraying of the water over the items located in the upper dish rack. However, the upper spray spinners occupy a substantial amount of vertical space in which dishes, glasses and the like cannot be placed because of the necessary clearance for the upper spray spinner. Further, for a dishwasher cabinet that has a greater interior width than depth, the centrally located spray spinner does not provide an adequate and equal amount of spray water to the lateral sides of the cabinet and dish racks and particularly toward the corners of the lateral sides because the length of the spray arms s limited by the depth of the dishwasher cabinet.

It is an object of the present invention to provide a novel form of water spraying device for a dishwasher, which device is relatively small and yet dependably provides a water spray throughout the desired area. A further object of this invention is to provide such a water spray device that may be located on the ceiling of the dishwasher cabinet and provide a spinning spray over the entire upper dish rack without significantly reducing the capacity of the upper dish rack. A still further object of this invention is to provide such a water spraying device that has only a single moving part that comprises a spinner for directing a spray of water in the desired manner. Another object of the present invention is to provide a unique water spraying system wherein such or similar water spraying devices are positioned in other than central locations of the dishwasher for providing a water spray at or near the lateral sides and corners of the dishwasher cabinet. Still another object of this invention is to provide such a water spraying system and device wherein the device may be oriented in any direction for aiming the spray at the location of the dishes. A still further object of this invention is to provide such a water spraying device for which the shape of the spray of water may be selected for maximizing the water spraying coverage for that particular location of the water spraying device. Another object of this invention is to provide such a water spraying device that is of simple construction and avoids plugging by food particles. Still another object of the present invention is to provide an improved form of rotating spray spinner with the plural arms provided with the unique spraying devices of this invention.

Other objects and advantages of the present invention will appear from the following descriptions of various embodiments and the accompanying drawings, wherein.

Figure 3:
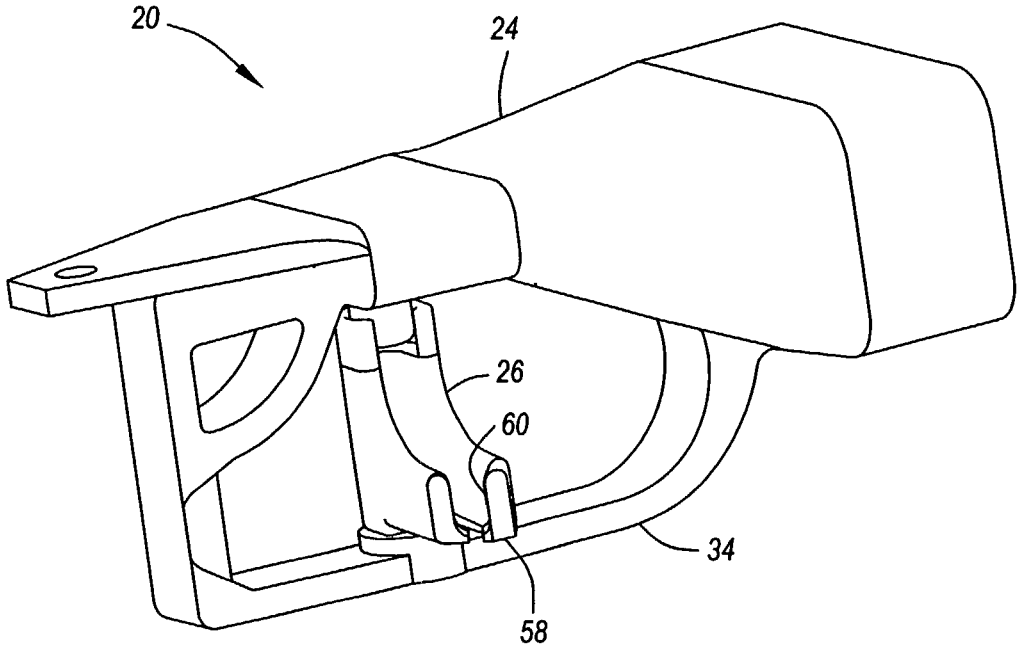
FIG. 3 is a perspective view of the ceiling mounted water spraying device of the present invention separate from the dishwasher cabinet.
Figure 4:
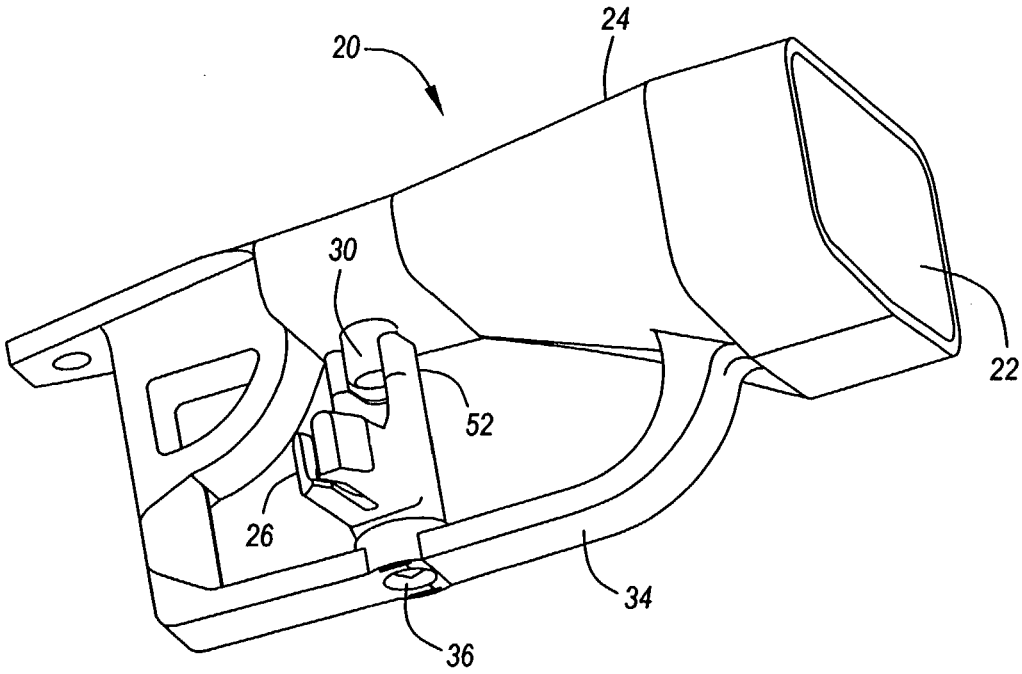
FIG. 4 is another perspective view of the water spraying device shown in FIG. 3 but from a different perspective.
Figure 5C:
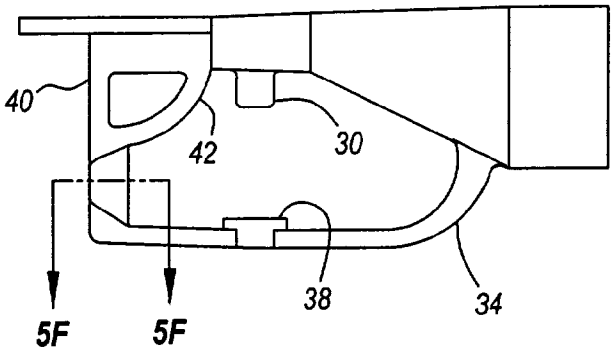
Figure 5E:
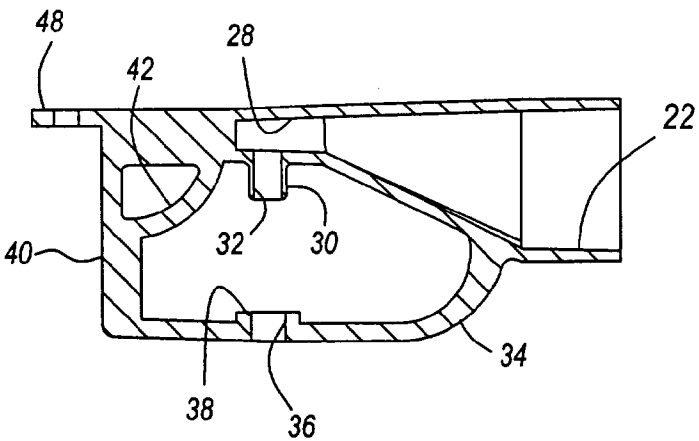
Figure 5B:
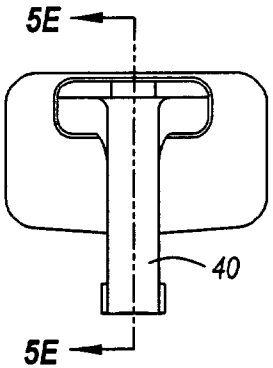
Figure 5D:
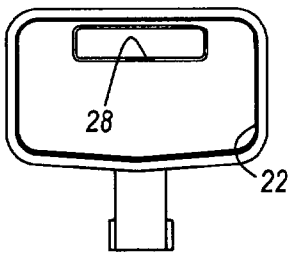
Figure 5F:
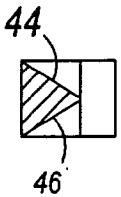
Figure 5A:
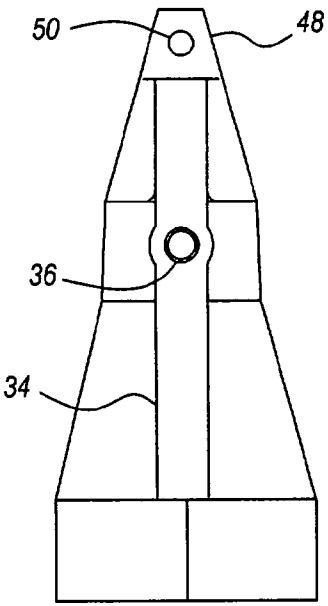
Figure 7:
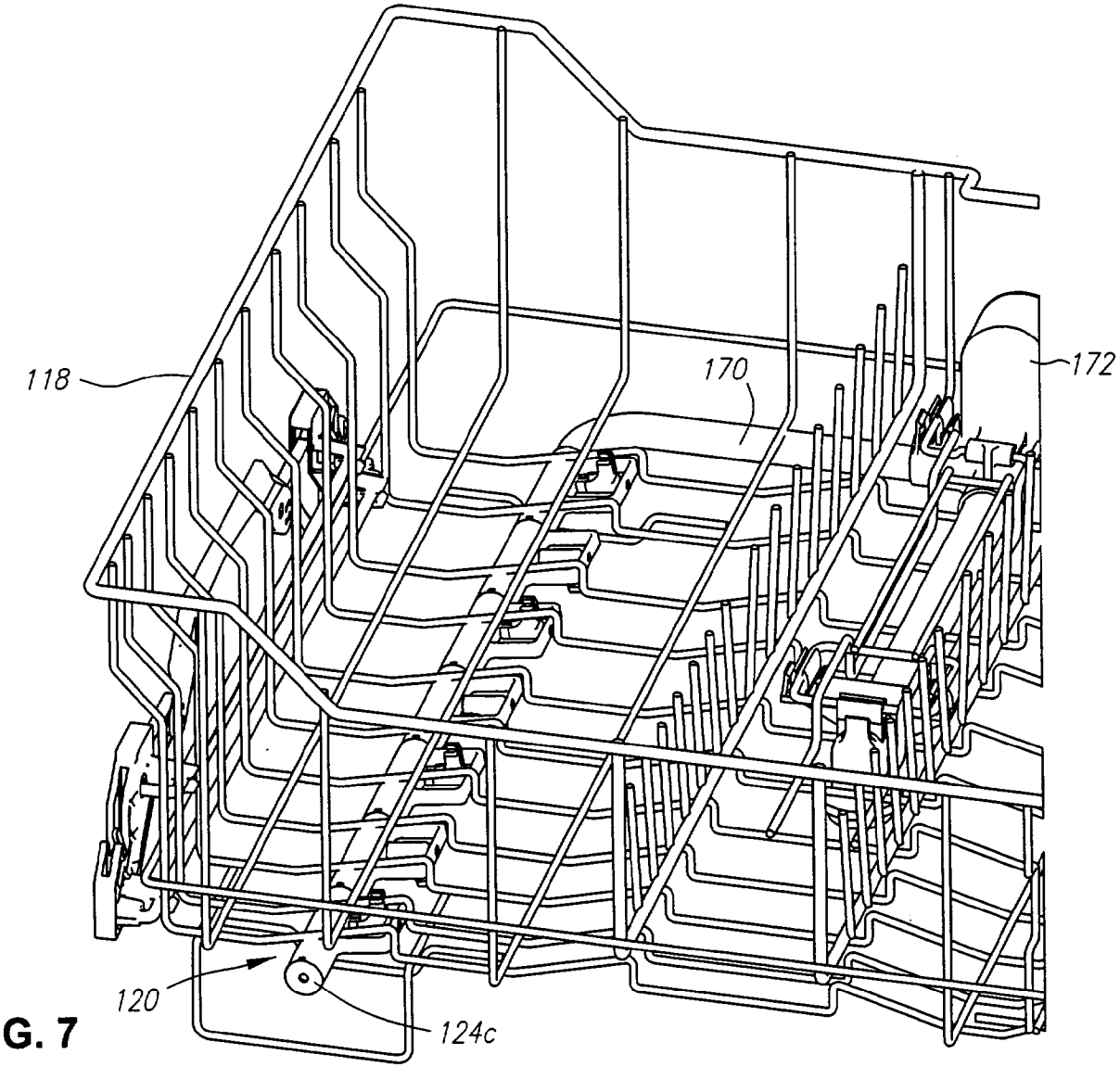
Figure 8:
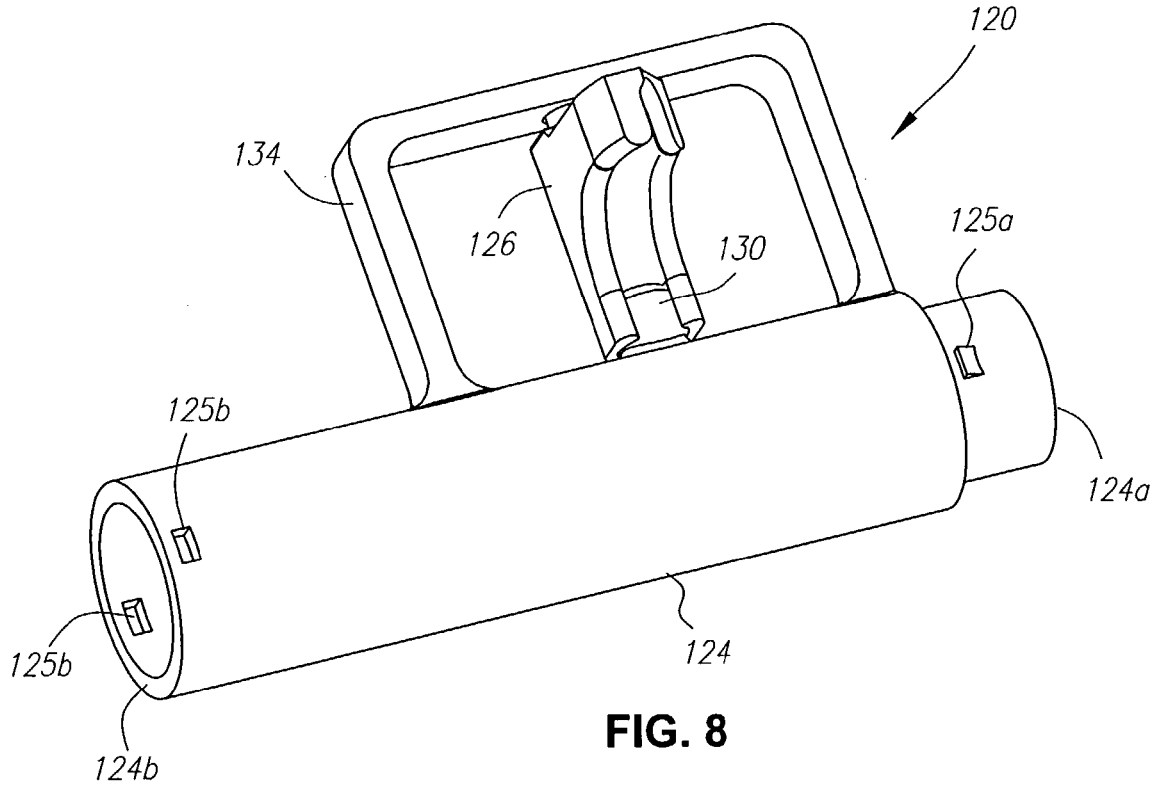
Figure 9:
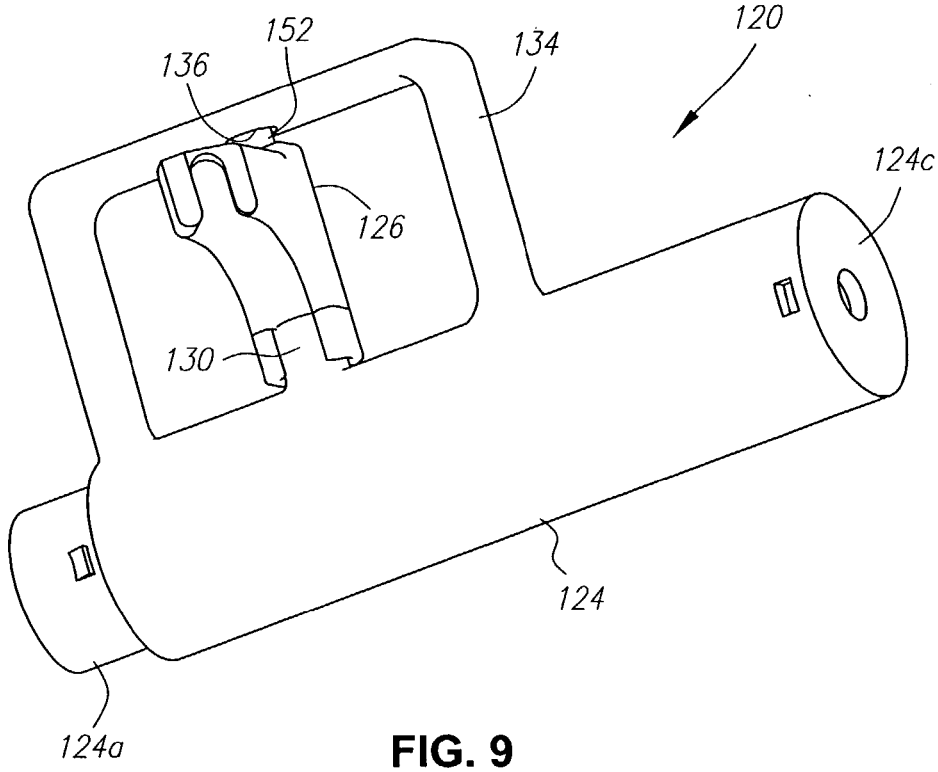
Figure 11:
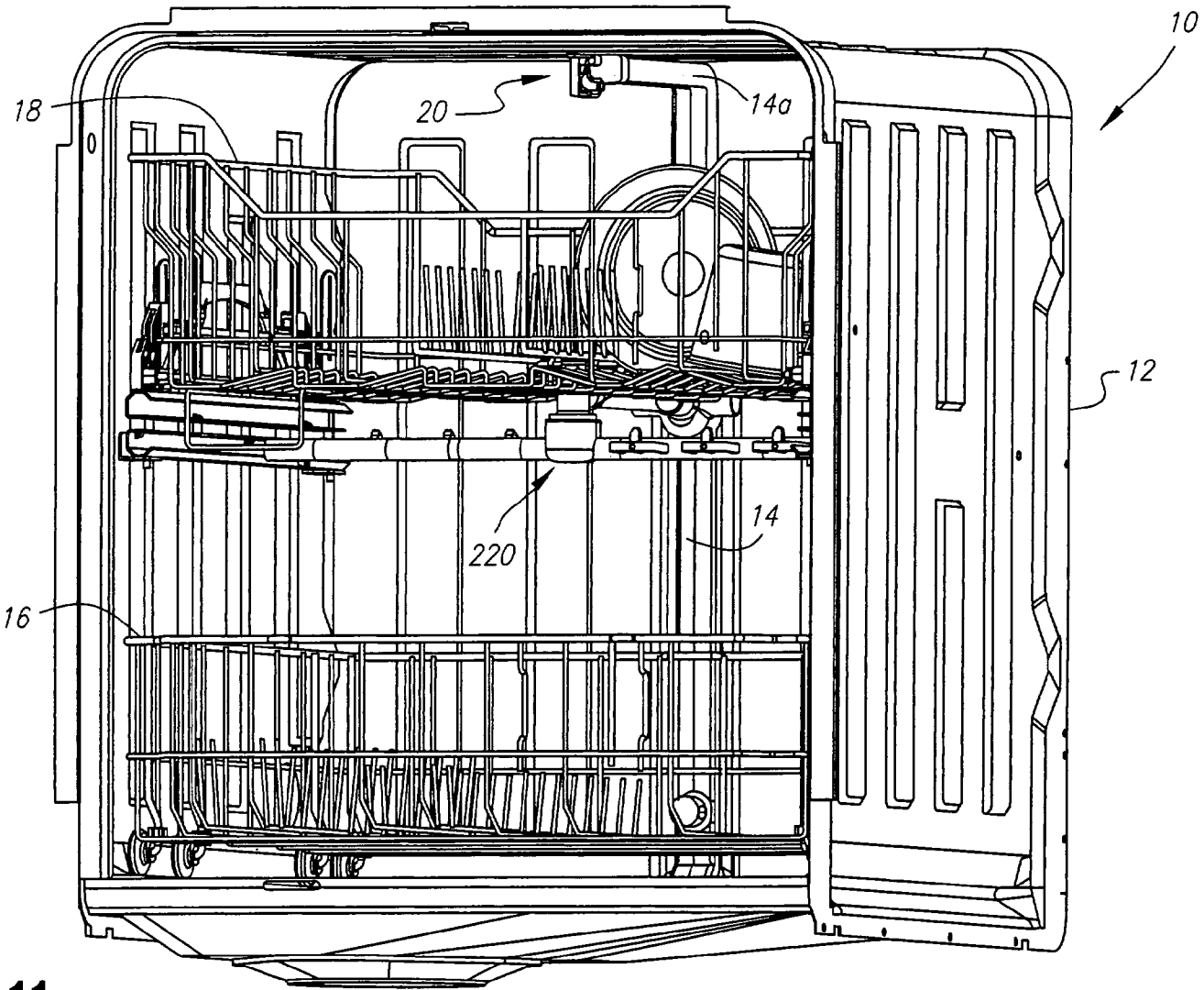
Figure 12:
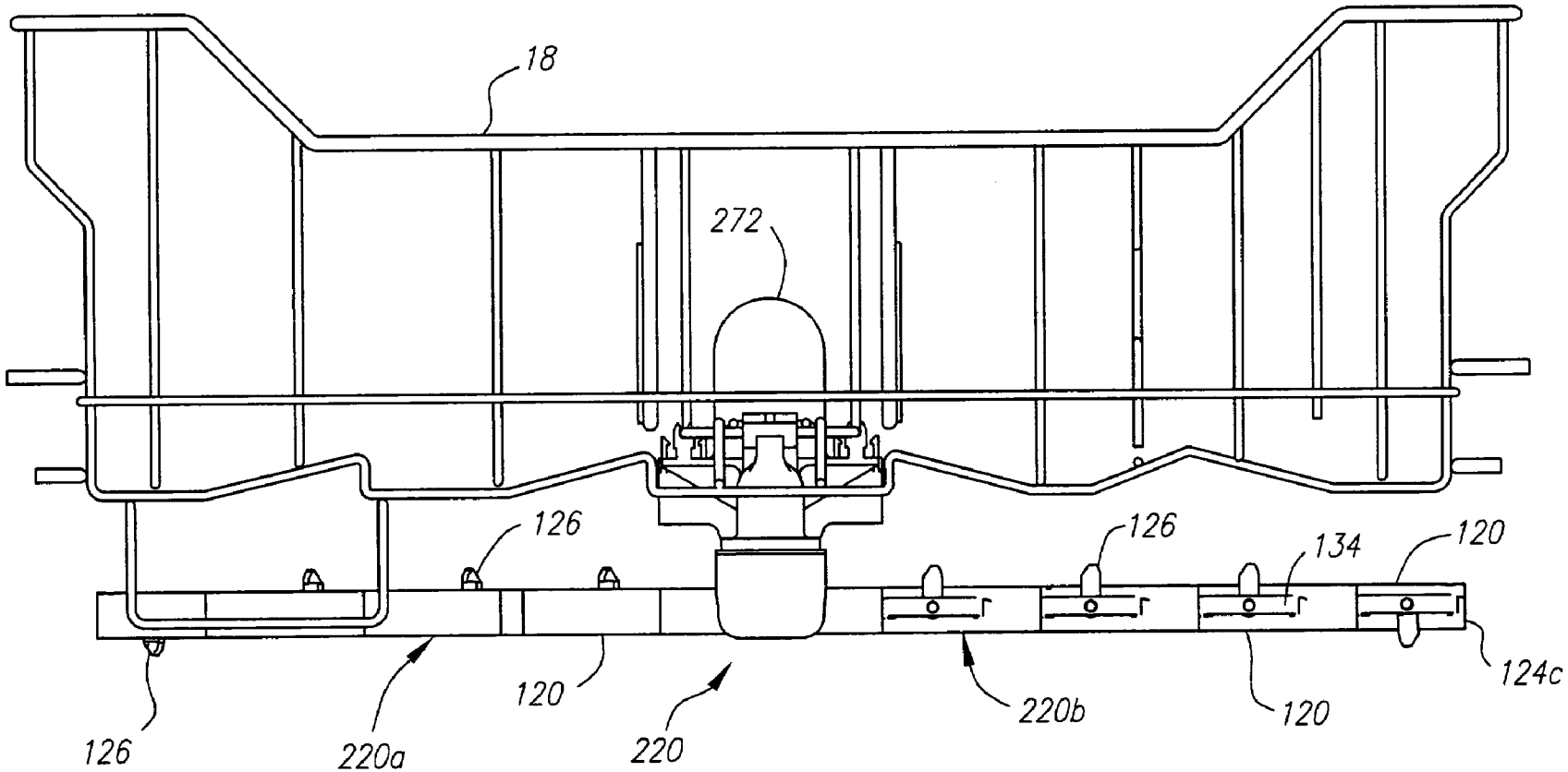
Figure 13:
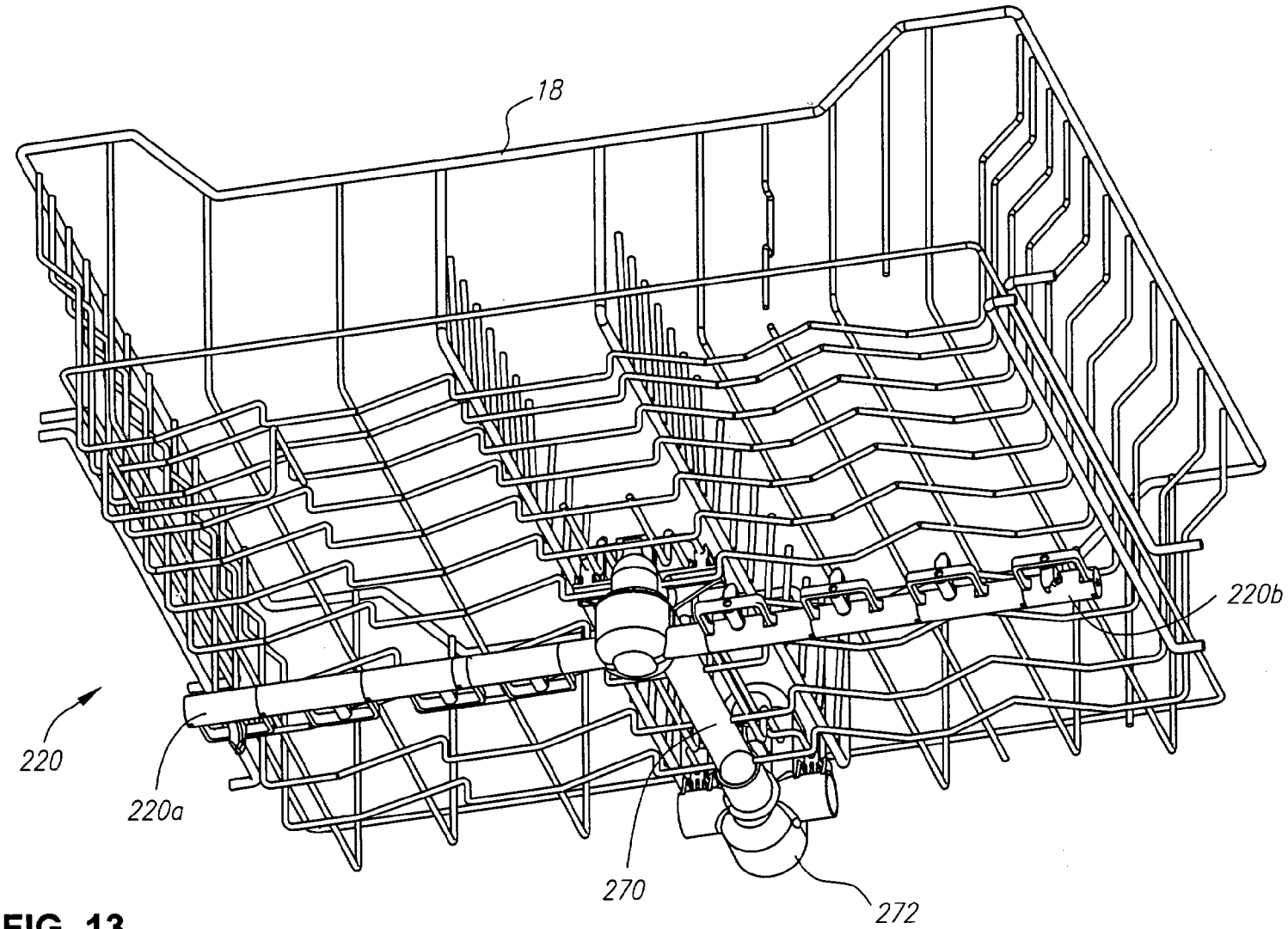

FIGS. 5A through 5F are views of the housing component of a preferred embodiment of the present invention shown in FIGS. 3 and 4, wherein FIG. 5A is a bottom view, FIG. 5B is a front elevation view, FIG. 5C is a right side elevation view, FIG. 5D is a rear elevation view, FIG. 5E is a sectional left side view taken substantially on the line 5E—5E in FIG. 5B, FIG. 5F is a sectional plan view taken substantially on the line 5F—5F shown in FIG. 5C;

FIGS. 6A through 6C are views of a spinner component of a preferred embodiment of the present invention adapted for use with the housing component of FIGS. 5A–5F, wherein FIG. 6A is an elevation view of the spinner, FIG. 6B is a plan view of the spinner, and FIG. 6C is a sectional elevation view of the spinner taken substantially on the line 6C—6C of FIG. 6A;

FIG. 7 is a perspective view of the upper dish rack of an optional or modified embodiment of the system of the present invention illustrating the water spraying devices at a lateral location and connected to a water supply tube for spraying upwardly and outwardly;

FIG. 8 is an enlarged perspective view of one of the modified forms of the water spraying device shown in FIG. 7;

FIG. 9 is another perspective view of the modified water spraying device shown in FIG. 8;

FIG. 10 is an enlarged perspective view of the spinner component of the modified form of the water spraying device shown in FIGS. 8 and 9;

FIG. 11 is a perspective view of a dishwasher cabinet and dish racks without a door and illustrating another embodiment of the water spraying devices and water spraying system of the present invention;

FIG. 12 is a front elevation view of the upper dish rack and unique upper rotating spray spinner of the embodiment of the present invention illustrated in FIG. 11; and FIG. 13 is a bottom, front perspective view of the upper dish rack and unique upper rotating spray spinner illustrated in FIG. 12.

Figure 1:
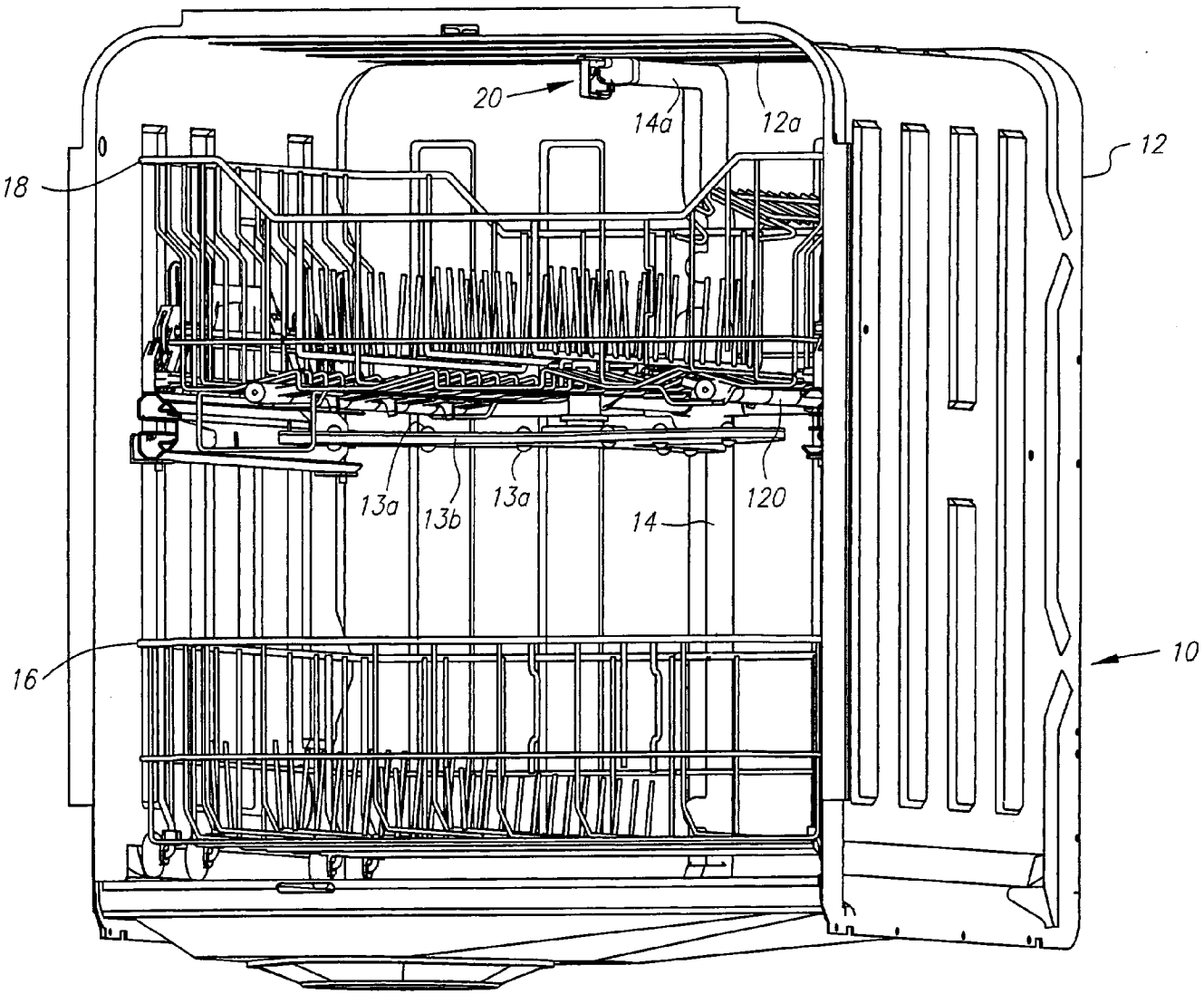
FIG. 1 is a perspective view of a dishwasher cabinet and dish racks without a door and illustrating a ceiling mounted water spraying device and an optional upper dish rack mounted water spraying devices of the present invention.
Figure 2:
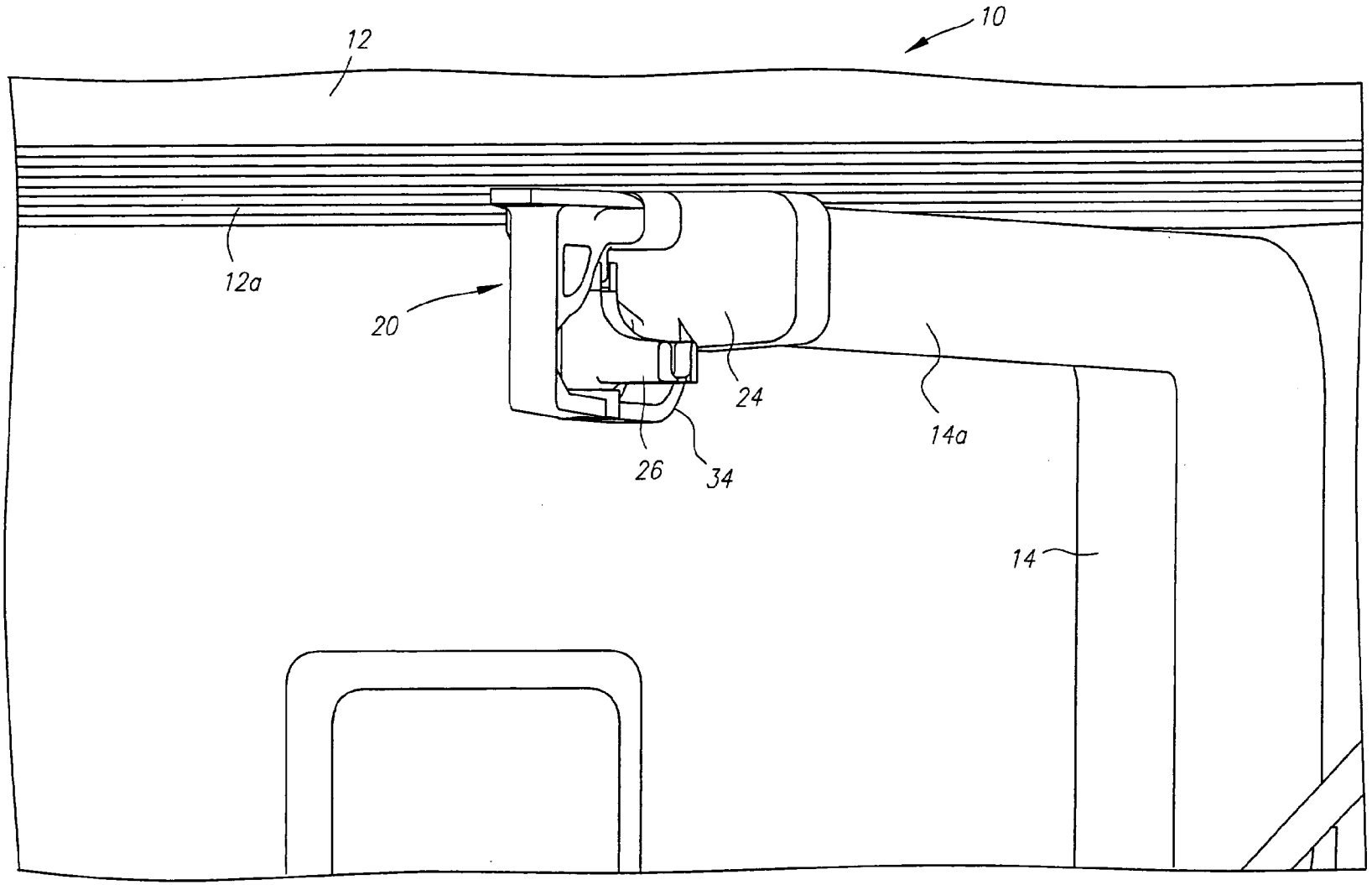
FIG. 2 is an enlarged perspective view of the ceiling mounted water spraying device of this invention.

Referring now to FIGS. 1 and 2, the dishwasher 10 may be relatively conventional in most respects and have a cabinet 12 with a door (not shown) on the front for selectively accessing the interior of the cabinet. A pump (not shown) is provided at the bottom of the cabinet 12 for supplying and recirculating water under pressure to a conventional spray spinner (not shown) with multiple spray arms located near the bottom of the cabinet 12, below a lower dish rack 16. The pump may also supply water to an intermediate level conventional spray spinner 13 with multiple arms and spray openings 13*a* for spraying upwardly and downwardly. In addition, for one embodiment of the present invention, the pump supplies the water to a conduit 14 extending upwardly along the back wall of the cabinet 12. Preferably, the conduit 14 is relatively flat (rectangular cross-section) for minimizing the front-to-back space occupied by the conduit 14. The dishwasher 10 is provided with a lower dish rack 16 and an upper dish rack 18, both of which are supported by rollers that allow the racks to be rolled forwardly out of the front of the cabinet 12 in a conventional manner for loading and unloading.

One preferred embodiment of the water spraying device, generally designated 20, of the present invention is mounted on the ceiling 12*a* of the cabinet 12 and is connected to a horizontal portion 14*a* of the flat conduit 14 that extends forwardly along the ceiling 12*a* of the cabinet. The conduit 14 or other conduits may be extended to other locations, such as in the corners of the cabinet 12, and provided one or more water spraying devices 20. Referring more particularly to FIGS. 3 and 4, it may be seen that the water spraying device 20 has a rectangular opening 22 at the rear (right hand) that fits onto (or optionally over) the horizontal portion 14*a* of the rectangular shaped conduit 14 for receiving pressurized water. In this preferred embodiment, the water spraying device 20 consists of only two components, namely, a shaped housing 24 and a rotatable nozzle or spinner 26. The spinner 26 is rotatably mounted on the housing 24, as fully described below, for receiving water from the housing 24 and spraying the water outwardly and downwardly from approximately the center of the ceiling 12*a* of the cabinet in a manner that is also described in more detail below.

Referring also to FIGS. 5A—5F that illustrate the shaped housing 24 in detail, the housing is hollow and tapers forwardly from the rectangular opening 22 to a rectangular chamber 28 (see FIGS. 5D and 5E). A stub shaft 30 extends downwardly from the chamber 28 and has a passage or orifice 32 for discharging the pressurized water downwardly from chamber 28 that is received from the conduit 14. The orifice 32 preferably is larger than food particles that might be circulated by the pump that are not retained by a strainer at the pump to avoid clogging of the orifice 32. The housing 24 has an integrally formed support structure or bracket 34 that extends from the front to the rear of the housing below the stub shaft 30. A hole 36 is provided in bracket 34 directly opposite and in line with the stub shaft 30. A raised collar 38 is provided on the upper side of the bracket 34 surrounding the hole 36 to support the spinner in an upwardly spaced relationship from the rest of the bracket 34 to prevent food particles from becoming lodged between the bracket 34 and the spinner 26 that would inhibit the rotation of the spinner. As an alternative construction, the stub shaft 30 may be replaced by a hole engaged by a stub shaft on the spinner and/or the hole 36 may be replaced by a stub shaft engaging a hole or socket in the spinner although certain advantages of the preferred construction would be lost.

The forward vertical portion 40 of the bracket 34 is of thickened cross section to provide strength to resist damage to the housing and spinner 26 from, for example, dishes or glasses in the upper rack 18 that extend close to the ceiling while the rack 18 is being rolled back into the dishwasher. A corner strut 42 enhances the strength of the vertical portion 40. The rear face of the portion 40 is provided With angled surfaces 44 and 46 (see FIGS. 50 and SF) for deflecting the water that is sprayed forwardly from the spinner 26. Similar angled surfaces may be provided on the rear portion of bracket 34. A forwardly extending tongue 48 on the housing 24 may be provided with a hole 50 for receiving a fastener to mount the housing 24 to the ceiling 12*a* of the cabinet 12.

Referring also to FIGS. 6A–6C, the preferred construction of the spinner 26 is provided with a stub shaft 52 for rotatably fitting in the hole 36 in bracket 34. The top of the spinner 26 is provided with a stiffly flexible, u-shaped collar 54 that snaps onto the stub shaft 30 of the housing 24 for rotatably supporting the spinner 26 on the housing 24. The spinner 26 has a width (left-to-right in FIGS. 6A and 6B) that equal to or less than the width of bracket 34 to protect the spinner from dishes and glasses as the upper dish rack 18 is moved in and out of the cabinet 12. The spinner 26 has an open passageway or trough 56 that extends downwardly from the water inlet at the top of the spinner and is curved outwardly to a discharge end 58 of the spinner whereby the water ejected downwardly from the orifice 32 is gradually redirected outwardly by the trough 56 of the spinner. The bottom of the trough near the discharge end 58 is provided with a slot 60 that allows the water to spray downwardly from the spinner 26 to thereby create a fan of spray water that approximates 900 from horizontally outwardly to vertically downward. The discharge end 58 of the spinner 26 has an angled portion 62 of the trough 56 (see FIG. 68) that is positioned at an angle to the radius extending outwardly from the axis of rotation of the spinner 26, such as at an angle of approximately 250 (650 from the tangent) to thereby cause the rotation of the spinner 26 as the water is ejected. Since the trough 56 is open, it resists any plugging by food particles and allows the water to spray outwardly. The arrangement of the relatively small orifice 32 discharging the water at a high velocity into the open trough 56 creates a high velocity spray over a wide area at a relative low circulating pressure of 3 psi, thereby avoiding damage to the dishwasher components that occurs at the higher pressures of 5 to 8 psi required for other dishwashers.

As an indication of the relatively small size of and ceiling space occupied by the water spraying device 20, without limitation as to the scope of the present invention, the housing 24 has an overall length of only about 2.8", a maximum width of about 1.32", and a maximum height of about 1.175", with the bracket 34 being only about 0.26" wide. Thus, the device 20 does not present an obstruction for dishes or glasses that cannot be avoided by merely a small lateral movement of any such dish or glass.

Referring now to FIGS. 7–10, a modified form of the invention is illustrated in which the water spraying device itself, its location and its application are somewhat different than heretofore described. To the extent that some components and elements are similar, numerals in the 100 series will be used for identification, and those elements that are the same will be numbered the same will not be described in detail again. Specifically, in this modified embodiment a plurality of water spraying devices 120 are mounted in series, end-to-end from the rear to the front of the upper rack 118 along the bottom of the rack and near each lateral side (only the left side is shown in FIG. 7) forming an extended conduit to spray upwardly through the dishes, glasses, etc. in the upper rack as well as downwardly onto the lower dish rack. This arrangement is particularly useful in dishwashers that are substantially wider than deep for enhancing the spraying at the lateral sides of the dishwasher cabinet because the length of the arms of a rotating spray spinner 13 (FIG. 1) are limited by the depth of the cabinet. Water is supplied to the plurality of water spraying devices 120 through lateral tubes 170 extending along the back of the rack 118 from a central water distribution housing 172 that in turn is connected to the flat conduit 14 (not shown) in FIG. 7 at the rear of the dishwasher cabinet 12. The connection between the water distribution housing 172 and the flat conduit 14 is releasable so that the upper rack 118 can be rolled forward and back in the conventional manner to load and unload the rack. For convenience of illustration and explanation, the laterally spaced series of spraying devices 120 are also shown on upper rack 18 in FIG. 1 although normally the dishwasher would not be provided with both the conventional intermediate level spray spinner 13 and the spraying devices 120 on the upper rack 18, 118.

Each water spraying device 120 includes a housing 124 which, in this embodiment, is hollow and of a tubular shape. One end 124*a* of the housing is of a smaller external diameter for fitting into and being joined with the other end 124*b* of an adjacent housing 124 for conveniently creating the in-line series of water spraying devices. However, if fewer water spraying devices are desired in the space between the front and rear of the rack 118, blank tubes can be used to connect the water spraying devices 120 in spaced relationship. The smaller end 124*a* with a pair of cleats 125*a* spaced 1800 apart for fitting into a pair of slots 125*b* larger end to connect adjacent housings 124 with or without adhesives. A plug 124*c* fits into the open end of the front water spraying device 120. Each water spraying device 120 includes a bracket 134 for supporting a spinner 126 in a manner substantially indentical to that which has been described above for supporting the spinner 26 on the bracket 34 in the first embodiment. Specifically, a stub shaft 130 is provided on housing 124 and has an internal orifice (not shown) identical or similar to orifice 32 for ejecting the water into the spinner 126. Further, the bracket 134 is provided with a hole 36 receiving a stub shaft 152 on spinner 126 similar to the hole 36 and stub shaft in that the previously described. In this embodiment, the spinner 126 is of a modified shape in that the open trough 156 does not curve for a full 900 but rather only, for example, 450 although any angle may be used whereby the spray of water from the spinner 126 is not perpendicular to the axis of the spinner 126 but rather creates a cone of spray water surrounding the axis. The trough 156 is provided with an angled portion 162 at the discharge end 158 of the spinner 126 for the discharging water to cause the spinner to rotate. The modified spinner 126 does not include a bottom slot similar to slot 60 in the bottom of trough 56 of the previously described spinner 26 that discharges the spray water in virtually an axial direction. In all other respects, the spinner 126 operates in the same manner to effectively spray the water but in a more concentrated direction. These modified water spraying devices 120 may be aimed in various directions to provide more comprehensive spray coverage, rather than all aimed in the same direction as shown in FIG. 7. Referring now to FIGS. 11–13, another modified embodiment of the water spraying system of the present invention that incorporates the water spraying devices of this invention is shown. Again the dishwasher 10 includes a cabinet 12 and upper and lower dish racks 18, 16 which may be conventional. Preferably a water spraying device 20 is provided in the center of the ceiling of a the cabinet 12, as described with respect to FIGS. 1–6. In this embodiment a rotating spray spinner assembly, generally designated 220, is rotatably suspended from the bottom of the upper dish rack 18. A conduit 270 is connected to and extends rearwardly from the spinner assembly 220 to a distribution housing 272 that is connected to the flat conduit 14 on the rear wall of the cabinet 12. The spinner assembly 220 includes a pair of diametrically extending arms 220*a* and 220*b*, although additional arms may be provided. Each of the arms 220*a*, 220*b* may be comprised of plural (four are shown) water spray devices 120 joined in-line with a plug 124*c* on the outermost end, similar to the assemblages illustrated in and described in connection with FIGS. 7–10. The water spray devices 120 in each arm may be angularly aligned or displaced from one another to provide the most comprehensive water spray pattern. Similarly, the individual spinners 126 may have troughs with different angles or slots, such as slots 60 in spinners 26, for producing a comprehensive water spray. At least one of the spinners 126 is positioned and provided with a trough shape that discharges water in a direction for causing rotation of the spinner assembly 220. Preferably the spinners 126 are shaped and positioned to spray water toward and through both the upper dish rack 18 and the lower dish rack 16.

Other modifications and applications of the water spraying devices and systems of this invention will readily appear to those skilled in the art.

What is claimed:

1. A water spraying device for dishwasher spray system, comprising:

a water supply conduit having a water passage, a support structure on said water supply conduit and extending to a position opposite and displaced from said water passage, said support structure including an elongate element having two ends extending at each end from said conduit to said position opposite and displaced from said water passage, and a spinner nozzle between and rotatably mounted to said conduit and said support structure, said spinner nozzle having an inlet communicating with said water passage and a discharge passageway in said spinner nozzle, and said discharge passageway shaped to discharge water at an angle to the axis of rotation of said spinner nozzle for causing rotation of said spinner nozzle, wherein said discharge passageway has an open, curved trough extending between a radial direction and an axial direction relative to the axis of rotation of the spinner nozzle.

2. The water spraying device of claim 1, wherein said discharge passageway has a slot through the bottom of the curved trough as the curved trough extends in the radial direction to cause a fan shape discharge of water.

3. The water spraying device of claim 1, wherein said support structure and said spinner nozzle have a rotary mounting for the spinner nozzle including a stub shaft and a socket.

4. The water spraying device of claim 3, wherein said stub shaft is on the spinner nozzle and said socket is a through hole receiving said stub shaft on said elongate element.

5. The water spraying device of claim 1, wherein said water passage includes a stub shaft extending into and rotatably engaging said trough and an orifice for discharging water into said discharge passageway at a high velocity through the stub shaft.

6. The water spraying device of claim 1, wherein said water passage in said conduit includes an orifice for discharging water into said discharge passageway at a high velocity.

7. The water spraying device of claim 1 further comprising:

a dishwasher ceiling, wherein said water spraying device is mounted on said dishwasher ceiling.

8. The water spraying device of claim 7 further comprising:

a dishwasher upper dish rack, wherein a plurality of said water spraying devices are mounted along the bottom of said upper dish rack.

9. The water spraying device of claim 1 further comprising:

a dishwasher upper dish rack, wherein a plurality of said water spraying devices are mounted along the bottom of upper dish rack.

10. The water spraying device of claim 1 further comprising:

a dishwasher rotating sprayer support, wherein a plurality of said water spraying devices are mounted on and extend outwardly from said dishwasher rotating sprayer support to form a spinner assembly.

11. A water spraying device for a dishwasher having a water supply, comprising:

a housing having a hollow interior for connecting to the dishwasher water supply, said housing having a support bracket extending outwardly from said housing, said support bracket having a hole facing said housing;

a stub shaft extending from said housing toward said hole and having an orifice communicating with the hollow interior of the housing for ejecting water toward said hole in said support bracket; and a spinner rotatably mounted on said housing by and between said stub shaft and bracket hole, said spinner having an open trough extending from said stub shaft toward said hole for receiving the water ejected said orifice, said trough being curved from adjacent said stub shaft to an outlet end for directing the water outwardly from the spinner, said outlet end having a deflector for deflecting the water laterally to cause the spinner to rotate.

12. The water spraying device of claim 11, wherein said spinner includes a spinner stub shaft rotatably engaging said hole in said bracket.

13. The water spraying device of claim 12, wherein said bracket includes a raised collar surrounding said hole for engaging a shoulder on said spinner to space the spinner from bracket portions extending away from said raised collar.

14. The water spraying device of claim 11, wherein said spinner includes u-shaped collar for snapping over said stub shaft for installation, and said u-shaped collar rotatably engaging and securing said spinner to said stub shaft.

15. The water spraying device of claim 14, wherein said spinner includes a spinner stub shaft rotatably engaging said hale in said bracket.

16. The water spraying device of claim 15, wherein said bracket includes a raised cedar surrounding said hole for engaging a shoulder on said spinner to space the spinner from bracket portions extending away from said raised collar.

17. The water spraying device of claim 11, wherein said support bracket is u-shaped and, with said housing, encircles and protects said spinner.

18. The water spraying device of claim 11, wherein said trough has a slot in the bottom to cause a portion of the water to be discharged substantially in a fan shape relative to direction of the axis at rotation of said spinner.

19. A water spraying device for dishwasher spray systems, comprising:

a water supply conduit having a laterally directed water passage, and a spinner nozzle rotatably mounted on said conduit, said spinner nozzle having an inlet communicating with said laterally directed water passage and a discharge passageway in said spinner nozzle, said discharge passageway being a single, open, curved trough extending from the axis of rotation of said spinner nozzle at said inlet to a radial direction and said discharge passageway shaped to discharge water at an angle to the axis of rotation of said spinner nozzle for causing rotation of said spinner nozzle, said laterally directed water passage in said conduit including an orifice for discharging water into said discharge passageway at a high velocity.

20. The water spraying device of claim 19 further comprising:

a dishwasher ceiling, wherein said water spraying device is mounted on said dishwasher ceiling.

21. The water spraying device of claim 20 further comprising:

a dishwasher upper dish rack, wherein a plurality of said water spraying devices are mounted along the bottom of said upper dish rack.

22. The water spraying device of claim 19 further comprising:

a dishwasher upper dish rack, wherein a plurality of said water spraying devices are mounted along the bottom of said upper dish rack.

23. The water spraying device of claim 19 further comprising:

a dishwasher rotating sprayer support, wherein a plurality of said water spraying devices are mounted on and extend outwardly from said dishwasher rotating sprayer support to form a spinner assembly.

24. The water spraying device of claim 19, wherein said discharge passageway has a slot through the bottom of the curved trough as the curved tough extends in the radial direction to cause a fan shape discharge of water.

25. The water spraying device of claim 19, wherein said laterally directed water passage includes a stub shaft extending into said trough and rotatably said spinner nozzle.

26. The water spraying device of claim 25, wherein said laterally directed water passage further includes an orifice for discharging water into said discharge passageway at a high velocity through tho stub shaft.

* * * * *

UNITED STATES PATENT AND TRADEMARK OFFICE

CERTIFICATE OF CORRECTION

PATENT NO. : 7,225,818 B2
APPLICATION NO. : 10/404731
DATED : June 5, 2007
INVENTOR(S) : Kim et al.

It is certified that error appears in the above-identified patent and that said Letters Patent is hereby corrected as shown below:

In claim 1 (col. 6, Ln 13), delete "system" and insert -- systems -- therefor.

In claim 9 (col. 6, Ln 67), after "of" insert -- said --.

In claim 15 (col. 7, Ln 40), delete "hale" and insert -- hole -- therefor.

In claim 16 (col. 7, Ln 41), delete "cedar" and insert -- collar -- therefor.

In claim 25 (col. 8, Ln 45), after "rotatably" insert -- engaging --.

In claim 26 (col. 8, Ln 50), delete "tho" and insert -- the -- therefor.

Signed and Sealed this

Seventeenth Day of July, 2007

JON W. DUDAS
*Director of the United States Patent and Trademark Office*